US005267929A

United States Patent [19]

Chen

[11] Patent Number: 5,267,929

[45] Date of Patent: Dec. 7, 1993

[54] PORTABLE HAND/LEG EXERCISER

[76] Inventor: Chyuan C. Chen, No. 88, Ching Li St., Tuu Cherng Hsiang, Taipei Hsien, Taiwan

[21] Appl. No.: 950,064

[22] Filed: Sep. 23, 1992

[51] Int. Cl.[5] ..... A63B 21/05

[52] U.S. Cl. ..... 482/128; 482/126; 482/122

[58] Field of Search ..... 482/126, 121, 122, 128

[56] References Cited

U.S. PATENT DOCUMENTS

| | | | |
|---|---|---|---|
| 3,497,216 | 2/1970 | Feather | 482/128 |
| 4,465,276 | 8/1984 | Cox | 482/128 |
| 4,861,022 | 8/1989 | Boatcallie | 482/126 |

FOREIGN PATENT DOCUMENTS

| | | | |
|---|---|---|---|
| 1489824 | 10/1977 | United Kingdom | 482/128 |

*Primary Examiner*—Richard J. Apley

*Assistant Examiner*—Lynne A. Reichard

*Attorney, Agent, or Firm*—Welsh & Katz, Ltd.

[57] ABSTRACT

A hand/leg exerciser includes a first arcuate handle unit, a second arcuate handle unit, and a resistance unit. The first arcuate handle unit includes a first handle end, a first pivotal end, and a first middle section therebetween. The second arcuate handle unit includes a second handle end, a second pivotal end pivoted to the first pivotal end, and a second middle section therebetween. The resistance unit includes an outer tube, an inner tube telescopically received in the outer tube, and a spring extending in the outer and inner tubes. The outer tube is securely attached to the first middle section while the inner tube is selectively attached to one of a plurality of positions in the second middle section, providing a variable resistance. An arcuate plate extends outward from an outside of each of the first and second middle section to provide a comfort contact for legs when exercising legs.

3 Claims, 3 Drawing Sheets

PORTABLE HAND/LEG EXERCISER

BACKGROUND OF THE INVENTION

The present invention relates to a multi-function exerciser and, more particularly, to a portable exerciser which can be used for exercising hands and legs.

Conventional multi-function exercisers are too bulky to be carried while portable exercisers are limited to exercise only one certain group of muscles. A portable hand/leg exerciser has been proposed to overcome the aforementioned drawbacks. This portable hand/leg exerciser includes two handle means pivoted at a pivotal means to which a torsion spring is attached to provide the required resistance; the two handle means lie on the same line before force is applied thereto. Nevertheless, such a portable hand/leg exerciser still has the following drawbacks: (1) it is not variable in resistance; (2) it is not suitable to leg exercise; and (3) the muscles are easily injured under improper operation. Therefore, there has been a long and unfulfilled need for a portable multi-function exerciser to mitigate and/or obviate the above-mentioned problems.

SUMMARY OF THE INVENTION

The present invention provides a portable multi-function hand/leg exerciser which includes a first arcuate handle means, a second arcuate handle means, and a resistance means. The first arcuate handle means includes a first handle end, a first pivotal end, and a first middle section therebetween. Similarly, the second arcuate handle means includes a second handle end, a second pivotal end pivoted to the first pivotal end, and a second middle section therebetween.

The resistance means includes an outer tube, an inner tube telescopically received in the outer tube, and a spring extending in the outer and inner tubes. The outer tube is securely attached to the first middle section while the inner tube is selectively attached to one of a plurality of positions in the second middle section, providing a variable resistance.

An arcuate plate extends outward from an outside of each of the first and second middle section to provide a comfort contact for legs when exercising legs.

Other advantages and novel features of the invention will become more apparent from the following detailed description when taken in conjunction with the accompanying drawings.

DETAILED DESCRIPTION OF THE PREFERRED EMBODIMENTS

Figure 1:
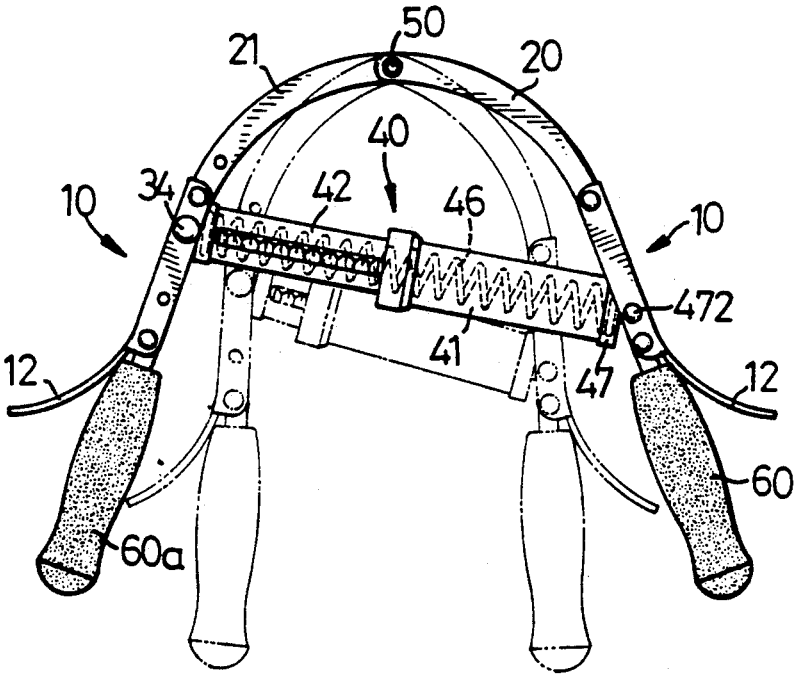
FIG. 1 is a schematic front elevational view of a portable hand/leg exerciser in accordance with the present invention.
Figure 2:
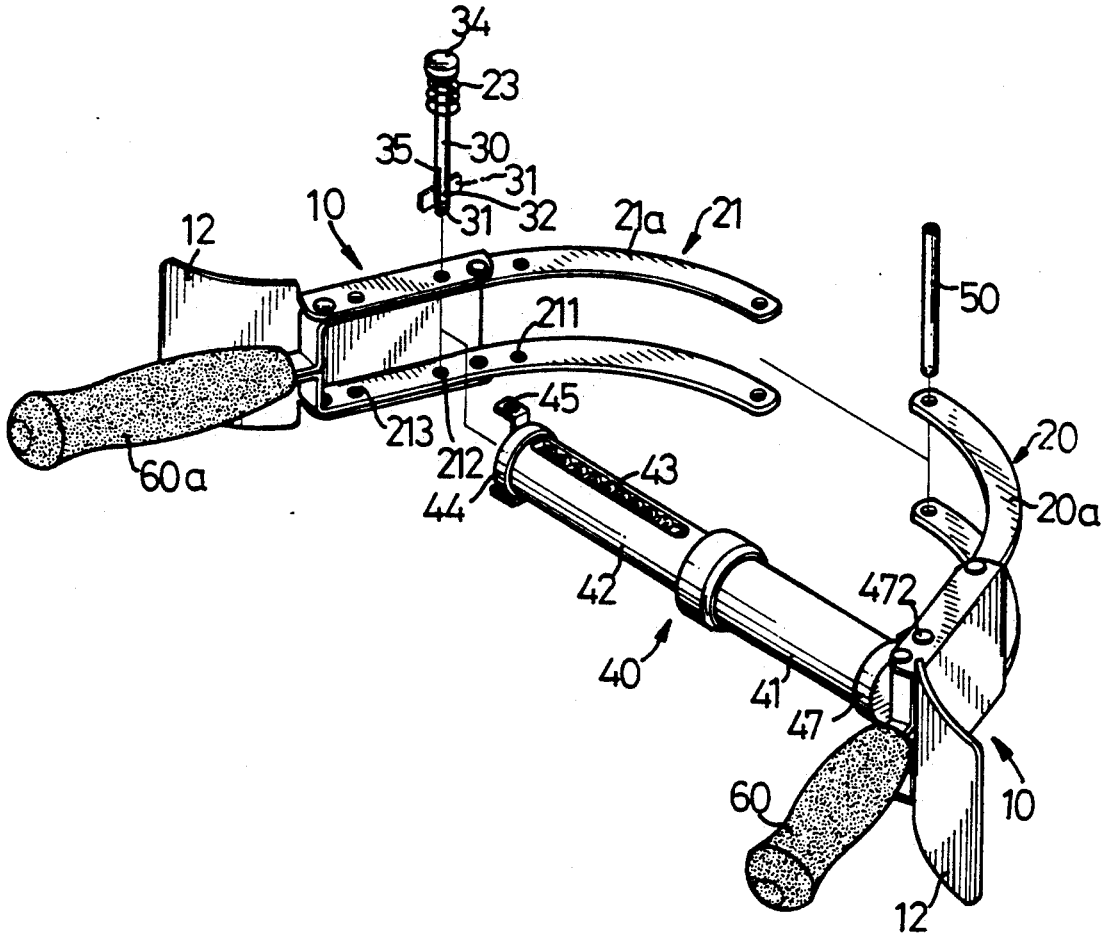
FIG. 2 is an exploded view of the portable hand/leg exerciser in accordance with the present invention

Referring to the drawings and initially to FIGS. 1 and 2, a portable hand/leg exerciser in accordance with the present invention generally includes a first arcuate handle means 20, a second arcuate handle means 21, and a resistance means 40. The first arcuate handle means 20 includes a first handle end 60, a first pivotal end, and a first middle section 20a therebetween. Similarly, the second arcuate handle means 21 includes a second handle end 60a, a second pivotal end pivoted to the first pivotal end by a pin 50, and a second middle section 21a therebetween. The resistance means 40 has a first end attached to the first middle section 20a and a second end attached to the second middle section 21a.

The resistance means 40 includes an outer tube 41, an inner tube 42 telescopically received in the outer tube 41, and a spring 46 extending in the outer and inner tubes 41 and 42 (see FIG. 1).

The first middle section 20a has a pair of joint holes 472 therein for securely joining an engaging end 47 of the outer tube 41. The second middle section 21a has three pairs of joint holes 211, 212, 213 therein one of which the engaging end 44 of the inner tube 42 is removably joined thereto, providing a variable resistance. In this embodiment, the inner tube 42 is attached to the middle pair of joint holes 212 by means of a pin means. The pin means includes a pin 30 with an enlarged end 34 and a distal end (not labeled) which has a slot 35 extending in a longitudinal direction of the pin 30, a spring 23 mounted to the enlarged end 34 of the pin 30, a pivot 32 mounted to the distal end of the pin 30 and extending transverse to the longitudinal direction of the pin 30, and a stop 31 mounted in the slot 35 and being pivotable about the pivot 32. Still referring to FIG. 2, when assembling the inner tube 42 onto the second middle section 21a, first attach the engaging end 44 of the inner tube 42 onto the second middle section 21a with holes 45 in the engaging end 44 in alignment with holes 212 in the second middle section 21a. Thereafter, pass the pin means 30 through the holes 45 and 212 with the stop 31 in a position in alignment with the pin 30 (see the solid lines). Finally, after the stop 31 is on the other side of the second middle section 21a, pivot the stop 31 to a position perpendicular to the pin 30 (see the phantom lines) to securely retain the inner tube 42 on the second middle section 21a. For disengaging, the above procedures are reversed after depressing the enlarged end 34 of the pin 30.

Figure 3:
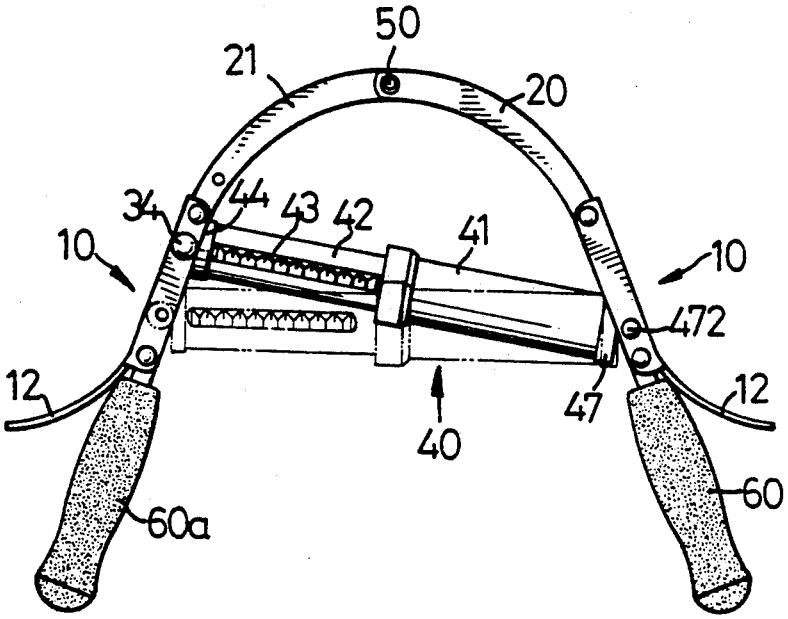
FIG. 3 is a view similar to FIG. 2 showing the change of resistant means.

It is understood that the inner tube 42 may be alternatively attached to the lowermost pair of joint holes 213 in the second middle section, as shown by phantom lines in FIG. 3. In this status, the resistance of the second handle means 21 is varied since the arm of lever is varied. It is further understood that more than one pair of joint holes may be provided in the first middle section 20a to provide more selections for resistance. Optionally, an indicia means 43 is provided on the inner tube 42 to indicate the magnitude of force applied to the exerciser.

Figure 4:
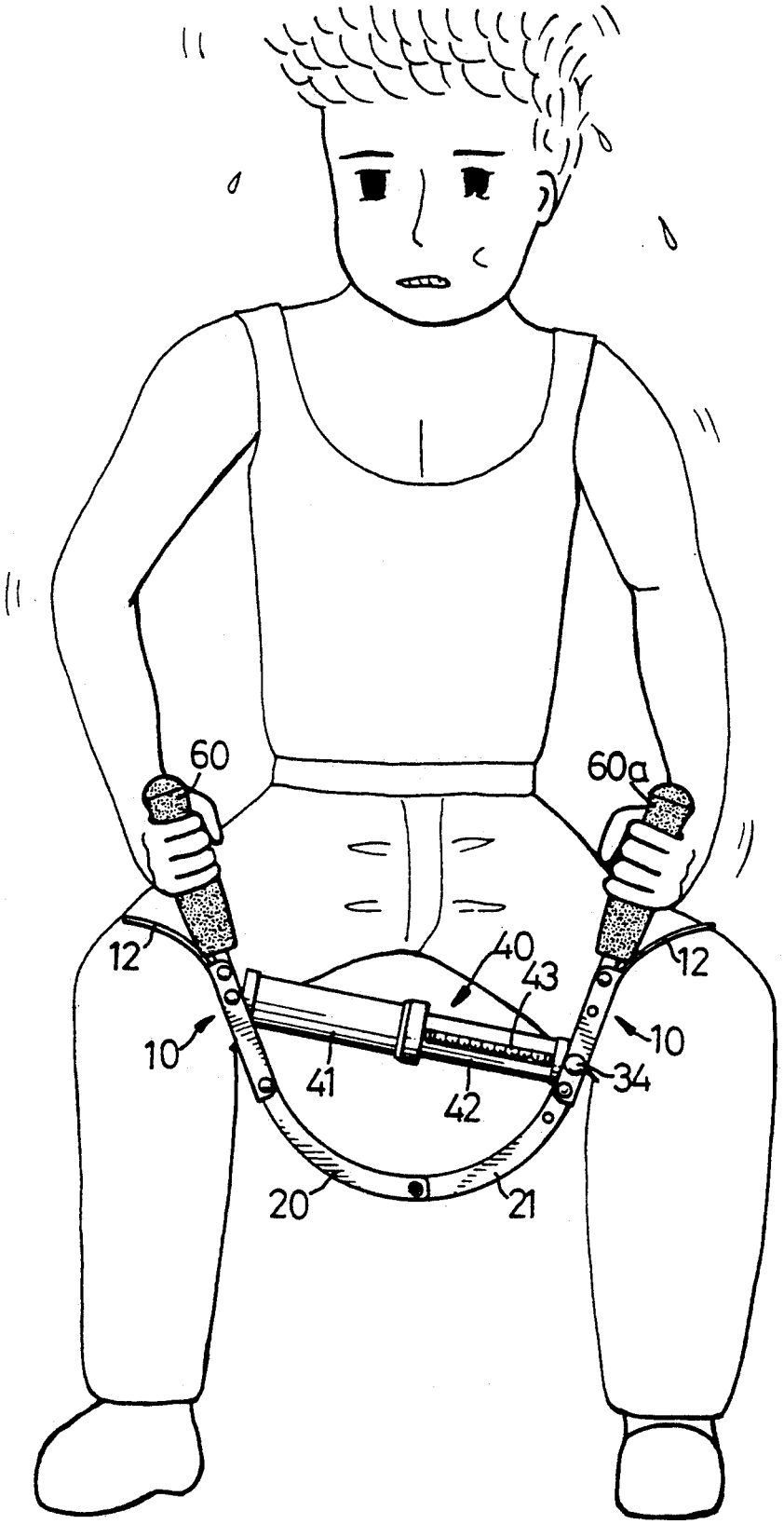
FIG. 4 is a schematic illustrating the use of the exerciser in accordance with the present invention.

A plate 10 is mounted to each of the first and second middle sections 20a and 21a. An arcuate plate 12 extends from each plate 10 and away from each corresponding handle 60 and 60a. The arcuate plates 12 are so configured that a comfort support is provided when the exerciser is used to exercise legs and is in a position shown in FIG. 4. Nevertheless, it is understood that the arcuate plate 12 may, without the provision of the plates 10, directly extend outward from an outside of each of the first and second middle section 20a and 21a which faces outside.

Although the invention has been explained in relation to its preferred embodiment, it is to be understood that many other possible modifications and variations can be made without departing from the spirit and scope of the invention as hereinafter claimed.

I claim:

1. An exerciser comprising:

a first handle means including a first handle end, a first pivotal end, and a first middle section therebetween;

a second handle means including a second handle end, a second pivotal end pivotedly attached to said first pivotal end, and a second middle section therebetween; and a resistance means with a first end attached to said first middle section and a second end attached to said second middle section, said resistance means comprising an outer portion with a first engaging end, an inner portion telescopically received in said outer portion and having a second engaging end, and a spring received in said outer and inner portions, said first middle section having a first retainer means therein for securely retaining said first engaging end of said outer portion, and said second middle section having a plurality of second retainer means therein for selectively and removably retaining said second engaging end of said inner portion at a plurality of positions on said second middle section to provide a variable resistance.

2. The exerciser as claimed in claim 1 wherein an arcuate plate extends outward from a side of each of said first and second middle section which faces outside.

3. The exerciser as claimed in claim 1 wherein said inner portion is attached to said second middle section by a pin means, said pin means including:

a pin having an enlarged end and a distal end which has a slot extending in a longitudinal direction of said pin, a spring mounted to said enlarged end of said pin, a pivot mounted to said distal end of said pin and extending transverse to the longitudinal direction of said pin, and a stop mounted in said slot and being pivotable about said pivot.

* * * * *